US012366373B2

(12) United States Patent
Landry et al.

(10) Patent No.: US 12,366,373 B2
(45) Date of Patent: Jul. 22, 2025

(54) STEAM EXCHANGE HUMIDIFIER

(71) Applicant: TECHNOLOGIES STEAMOVAP INC., Montreal (CA)

(72) Inventors: Éric Landry, Montreal (CA); Miguel Belanger Drouin, Montreal (CA); Jean-François Boyer, Montreal (CA)

(73) Assignee: TECHNOLOGIES STEAMOVAP INC., Montreal (CA)

( * ) Notice: Subject to any disclaimer, the term of this patent is extended or adjusted under 35 U.S.C. 154(b) by 439 days.

(21) Appl. No.: 17/796,659

(22) PCT Filed: Jan. 29, 2021

(86) PCT No.: PCT/CA2021/050097
§ 371 (c)(1),
(2) Date: Jul. 31, 2022

(87) PCT Pub. No.: WO2021/151202
PCT Pub. Date: Aug. 5, 2021

(65) Prior Publication Data

US 2022/0390129 A1 Dec. 8, 2022

Related U.S. Application Data

(60) Provisional application No. 62/968,278, filed on Jan. 31, 2020.

(51) Int. Cl.
*F24F 6/18* (2006.01)
*F24F 6/00* (2006.01)

(52) U.S. Cl.
CPC ..... *F24F 6/18* (2013.01); *F24F 2006/008* (2013.01)

(58) Field of Classification Search
CPC ..... F24F 6/18; F24F 2006/008
USPC ..... 261/DIG. 10, 76, 141
See application file for complete search history.

(56) References Cited

U.S. PATENT DOCUMENTS

| | | | | |
|---|---|---|---|---|
| 4,239,956 A | | 12/1980 | Morton | |
| 4,384,873 A | | 5/1983 | Herr | |
| 4,770,239 A | | 9/1988 | Duponteil | |
| 5,000,765 A | | 3/1991 | Nelson | |
| 5,099,823 A | * | 3/1992 | Nelson | F24F 6/18 220/325 |
| 5,666,910 A | | 9/1997 | George, II et al. | |
| 5,855,823 A | | 1/1999 | MacGibbon et al. | |
| 6,705,535 B1 | | 3/2004 | Morton | |

(Continued)

FOREIGN PATENT DOCUMENTS

| | | | |
|---|---|---|---|
| CN | 2257013 Y | * | 6/1997 |
| CN | 102563608 A | | 7/2012 |

(Continued)

*Primary Examiner* — Charles S Bushey
(74) *Attorney, Agent, or Firm* — Rivka Friedman

(57) ABSTRACT

A steam exchange humidifier including a heat exchanger inside a tank, the tank includes a drain and fluid inlet port for fluid in and out of the tank and a steam outlet. The heat exchanger includes a heat exchanger array, a steam collector, a condensate collector, a steam supply port and a condensate return port. The steam collector is connected to the steam supply port, and the condensate collector is connected to the condensate return port, the steam collector and the condensate collector being connected by the heat exchanger array, the tank being a generally vertical body.

19 Claims, 13 Drawing Sheets

(56) References Cited

U.S. PATENT DOCUMENTS

| | | | | |
|---|---|---|---|---|
| 7,377,307 | B1 * | 5/2008 | Ijiri | F28F 9/02 165/157 |
| 7,766,310 | B2 * | 8/2010 | Wolff | F24F 6/00 261/119.1 |
| 8,534,645 | B2 * | 9/2013 | Lundgreen | B01F 23/21321 261/115 |
| 9,253,824 | B2 | 2/2016 | Inoue et al. | |
| 2002/0163092 | A1 * | 11/2002 | Park | H01L 21/67051 261/118 |
| 2005/0073064 | A1 * | 4/2005 | Kopel | F22B 7/12 261/128 |
| 2008/0317447 | A1 | 12/2008 | Lentz et al. | |
| 2009/0107659 | A1 | 4/2009 | Hanamura | |
| 2011/0140291 | A1 | 6/2011 | Hoglund | |
| 2012/0038070 | A1 * | 2/2012 | Abel | F22B 37/50 261/151 |
| 2018/0266713 | A1 | 9/2018 | Buschle | |
| 2019/0049133 | A1 | 2/2019 | Cai | |
| 2022/0146130 | A1 | 5/2022 | Kwon et al. | |
| 2022/0404042 | A1 | 12/2022 | Bae et al. | |

FOREIGN PATENT DOCUMENTS

| | | | | |
|---|---|---|---|---|
| CN | 205561592 | U | * | 9/2016 |
| CN | 109737368 | A | | 5/2019 |
| CN | 114963374 | A | | 8/2022 |
| DE | 19607940 | A1 | | 9/1997 |
| JP | 2007257891 | A | | 10/2007 |
| KR | 20190066832 | A | | 6/2019 |
| KR | 200494642 | Y1 | | 11/2021 |
| RU | 2381422 | C1 | | 2/2010 |

* cited by examiner

STEAM EXCHANGE HUMIDIFIER

FIELD OF THE INVENTION

The present invention relates to steam generation. More specifically, the present invention is concerned with a steam exchange humidifier.

BACKGROUND OF THE INVENTION

A steam exchange humidifier as illustrated in FIGS. 1A, 1B and 2 for example typically comprises a heat exchanger inside an elongated horizontal tank. It is a bulky assembly, and disassembly of the heat exchanger for cleaning purpose for instance is time consuming. Because of bulkiness and weight issues, wall installation requires specific supporting hardware. Also, in terms of efficiency, depending on the slopes of the horizontal exchanger tubes of the heat exchanger, the condensate may be very slow to drain, which may lead to performance problems or reduce the efficiency of the heat exchange.

There is thus a need in the art for a system and a method for generating steam.

SUMMARY OF THE INVENTION

More specifically, in accordance with the present invention, there is provided a steam exchange humidifier, comprising a heat exchanger inside a tank, the tank comprising a drain and fluid inlet port for fluid in and out of the tank and a steam outlet; the heat exchanger comprising a heat exchanger array, a steam collector connected to a steam supply port, a condensate collector connected to a condensate return port; the steam collector and the condensate collector being connected by the heat exchanger array; wherein the tank is a generally vertical body.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

A steam exchange humidifier according to an embodiment of an aspect of the present disclosure as schematically illustrated in FIGS. 3 to 7 comprises a heat exchanger 12 inside a tank 20.

Figure 1A:
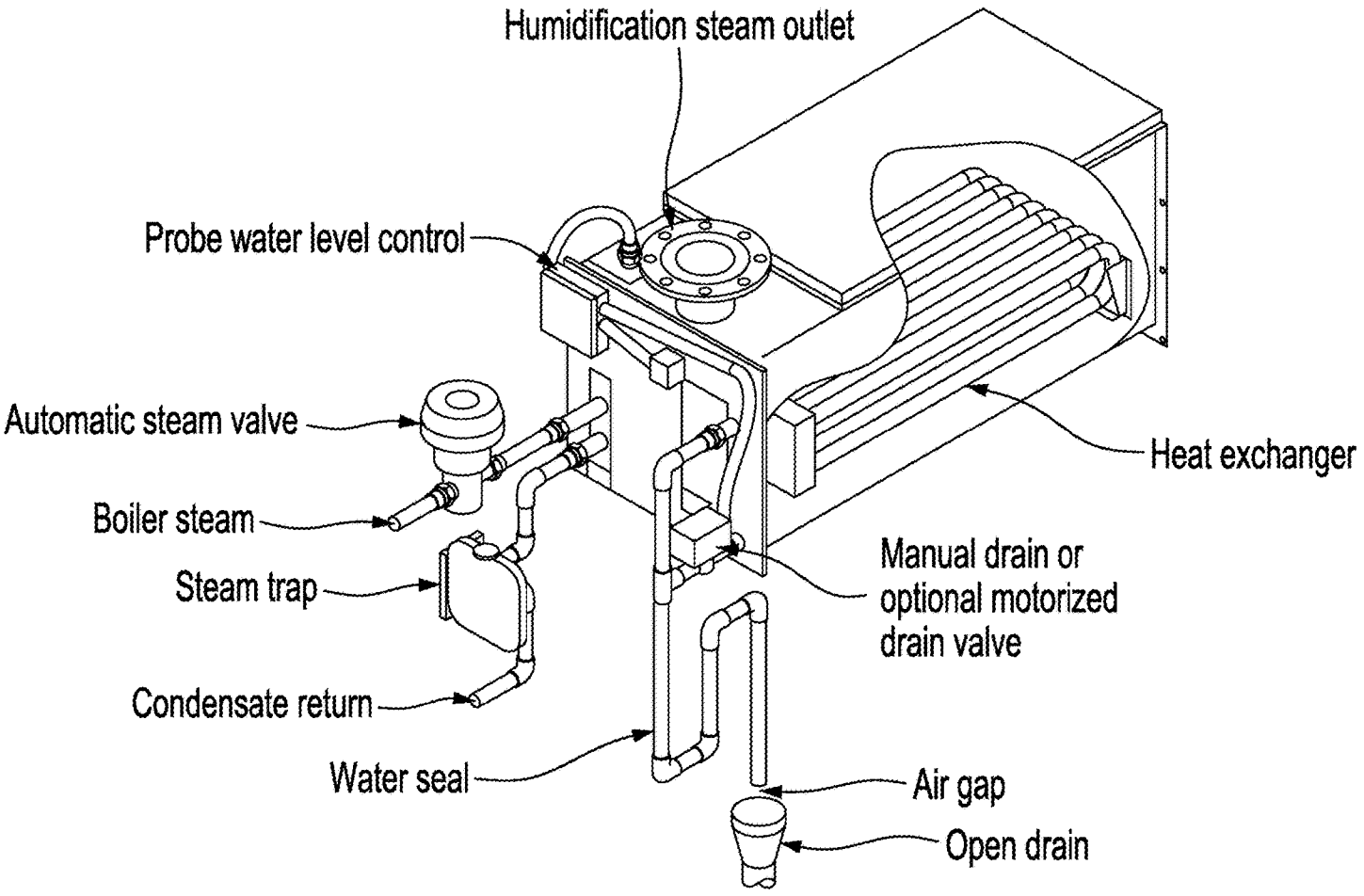
FIG. 1A (Prior Art)
FIG. 1A is a schematic view of a steam exchange humidifier as known in the art.
Figure 1B:
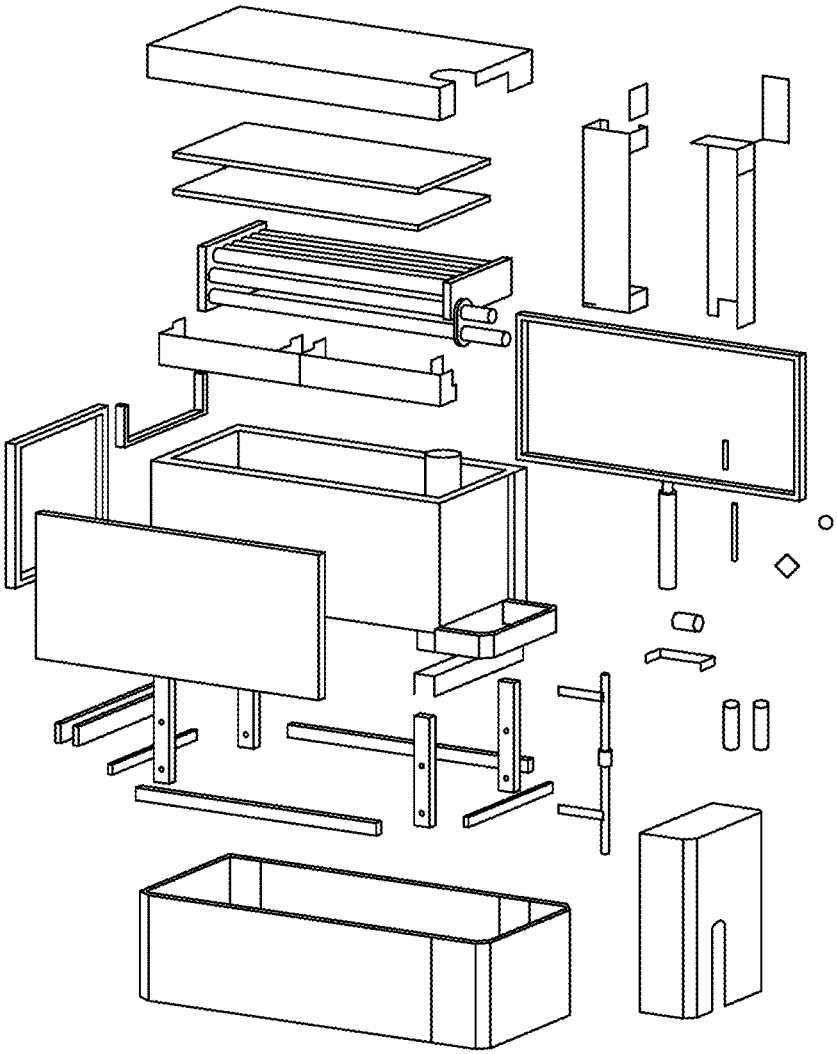
FIG. 1B (Prior Art)
FIG. 1B is an exploded view of the steam exchange humidifier of FIG. 1A.
Figure 2:
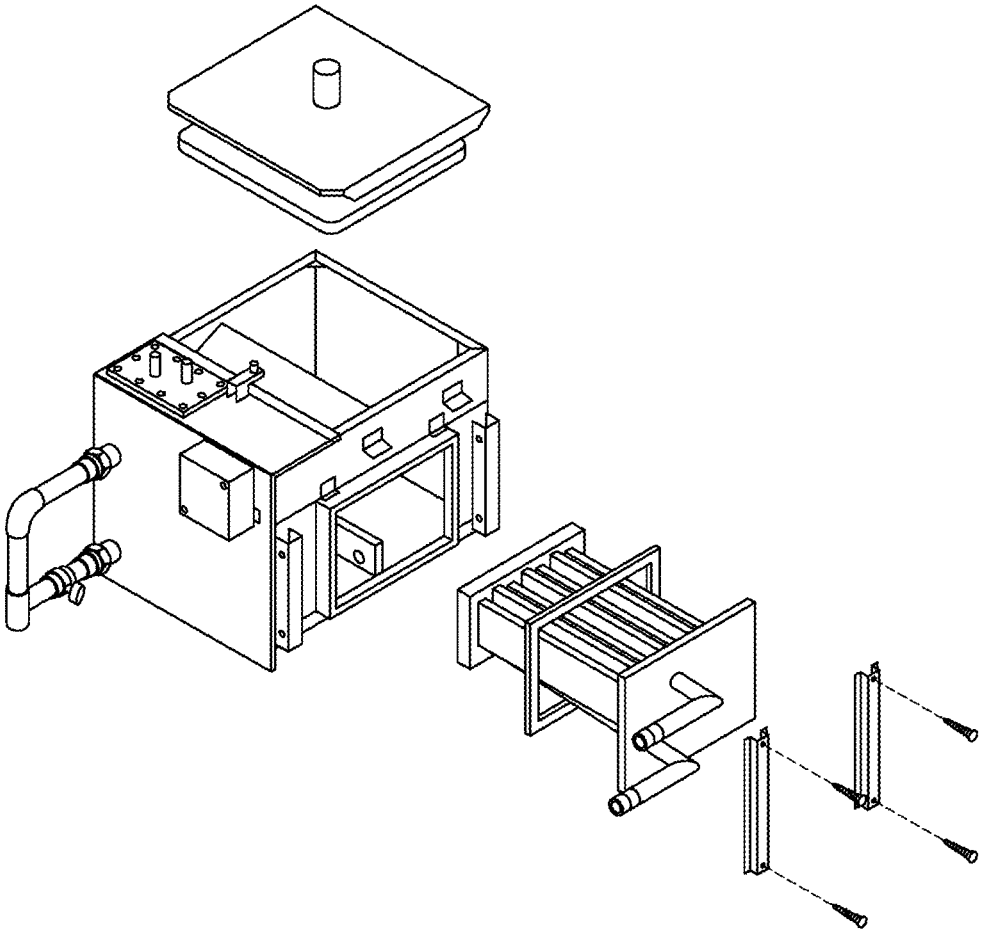
FIG. 2 (Prior Art)
FIG. 2 shows is a partly exploded view of a steam exchange humidifier combination as known in the art.
Figure 3A:
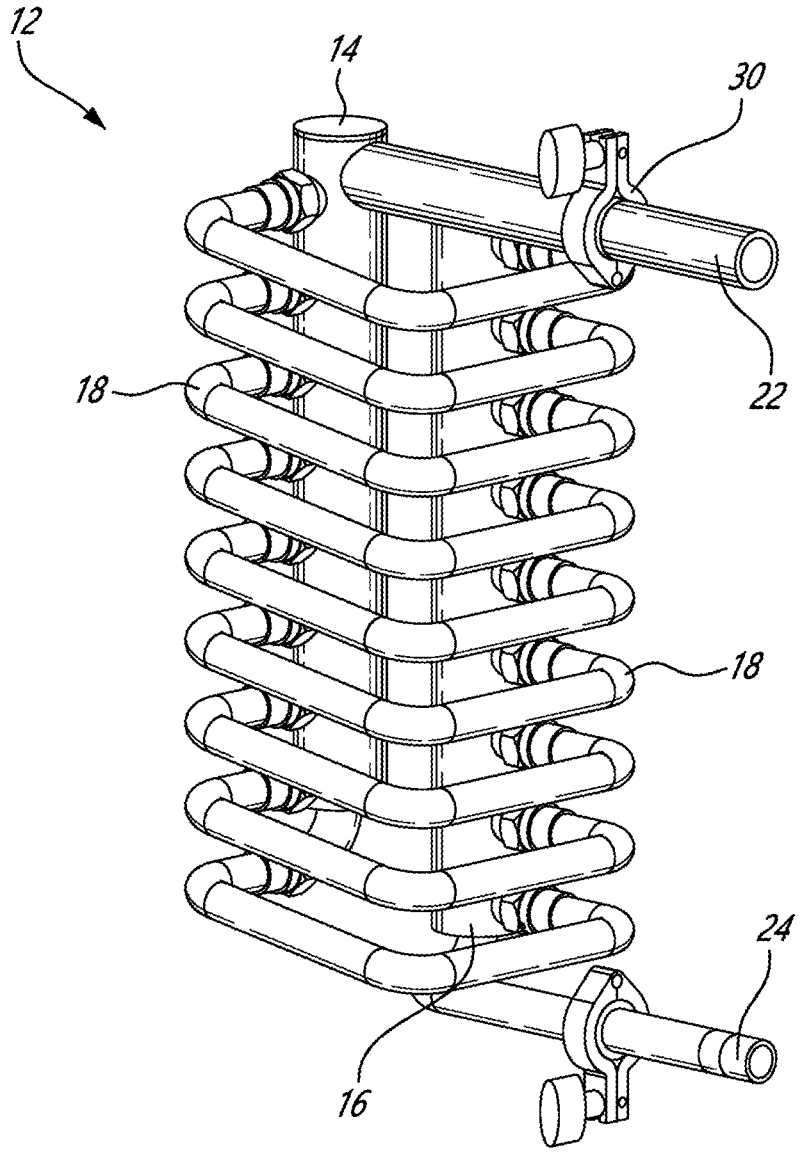
FIG. 3A is a schematic view of heat exchanger according to an embodiment of an aspect of the present disclosure.
Figure 3B:
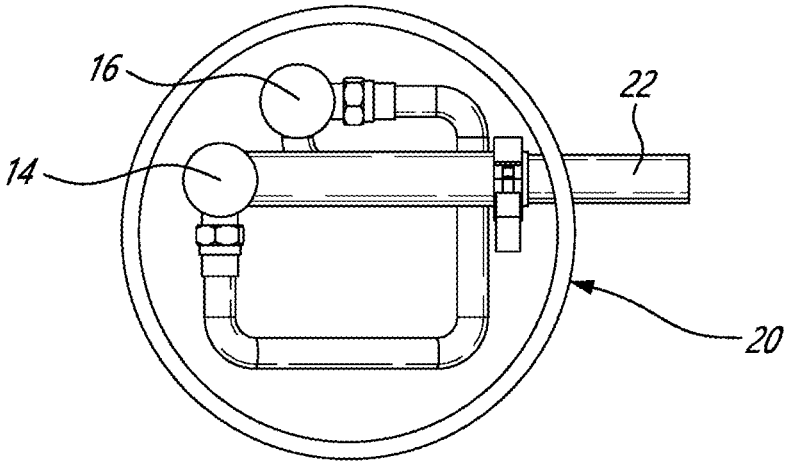
FIG. 3B is a schematic view of a cylindrical tank for the heat exchanger of FIG. 3A according to an embodiment of an aspect of the present disclosure.
Figure 3C:
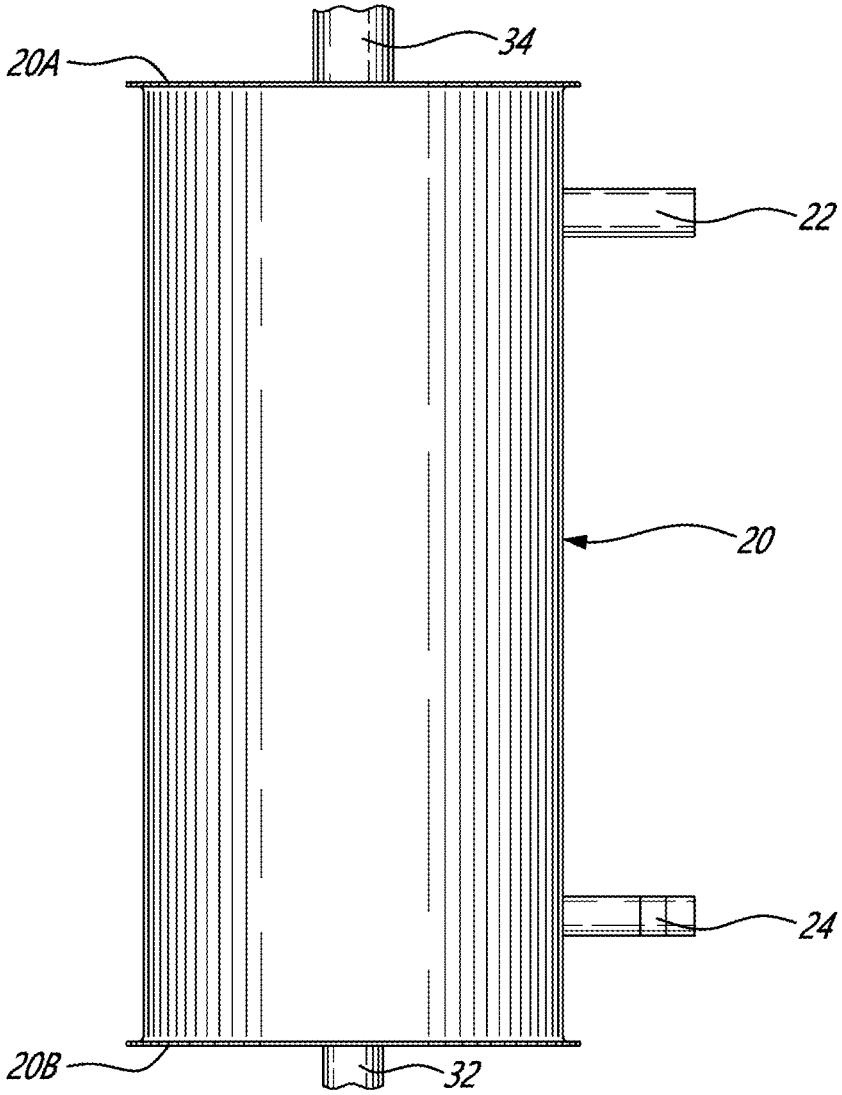
FIG. 3C shows a front view of a tank for the heat exchanger of FIG. 3A according to an embodiment of an aspect of the present disclosure.
Figure 4A:
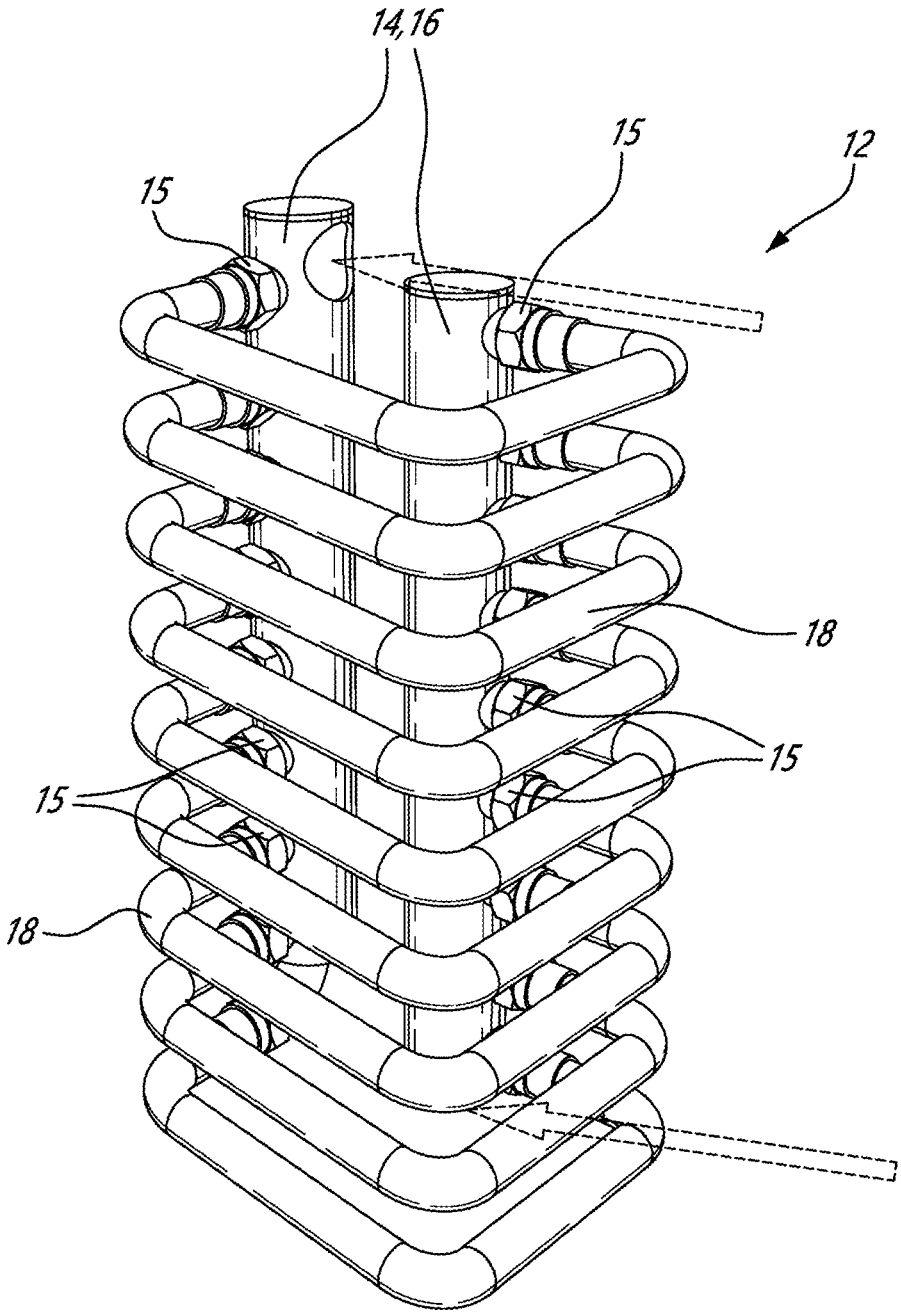
FIG. 4A shows a heat exchanger according to an embodiment of an aspect of the present disclosure.
Figure 4B:
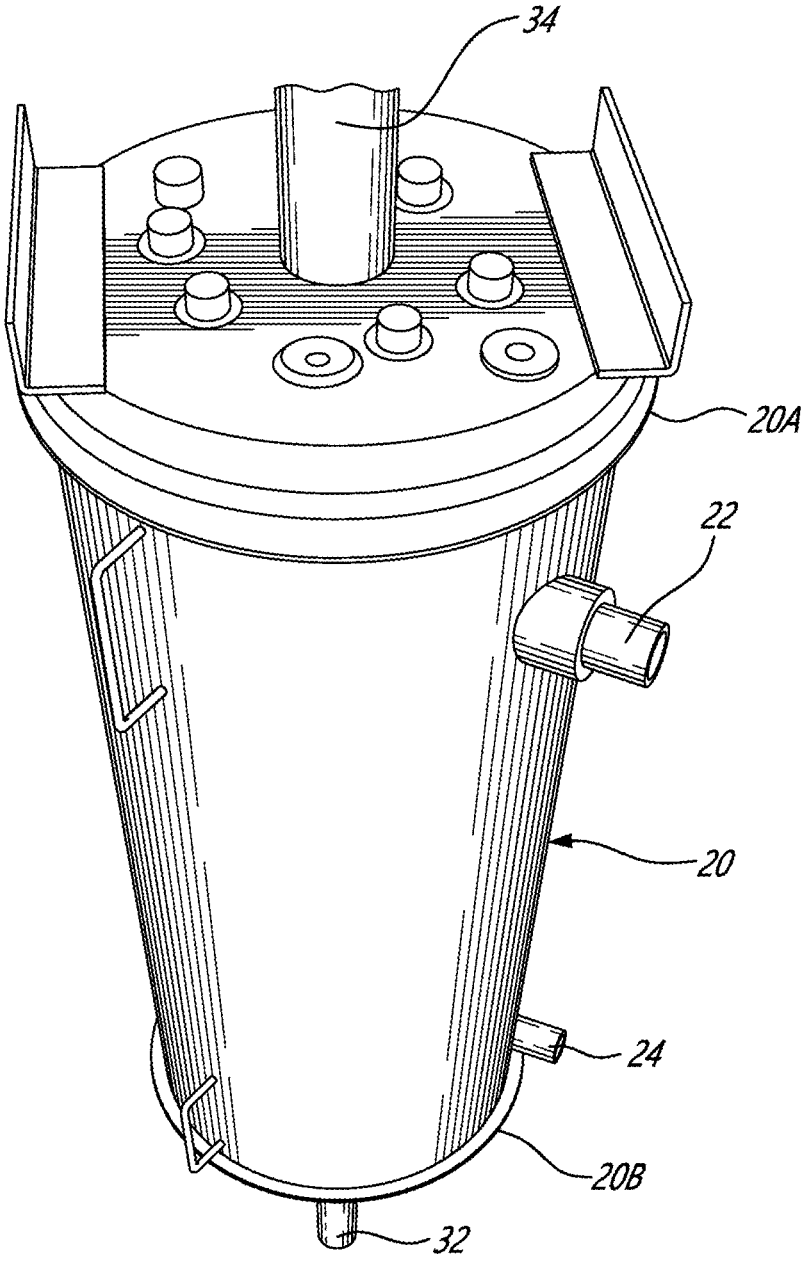
FIG. 4B shows a cylindrical tank for the heat exchanger of FIG. 4A according to an embodiment of an aspect of the present disclosure.
Figure 5:
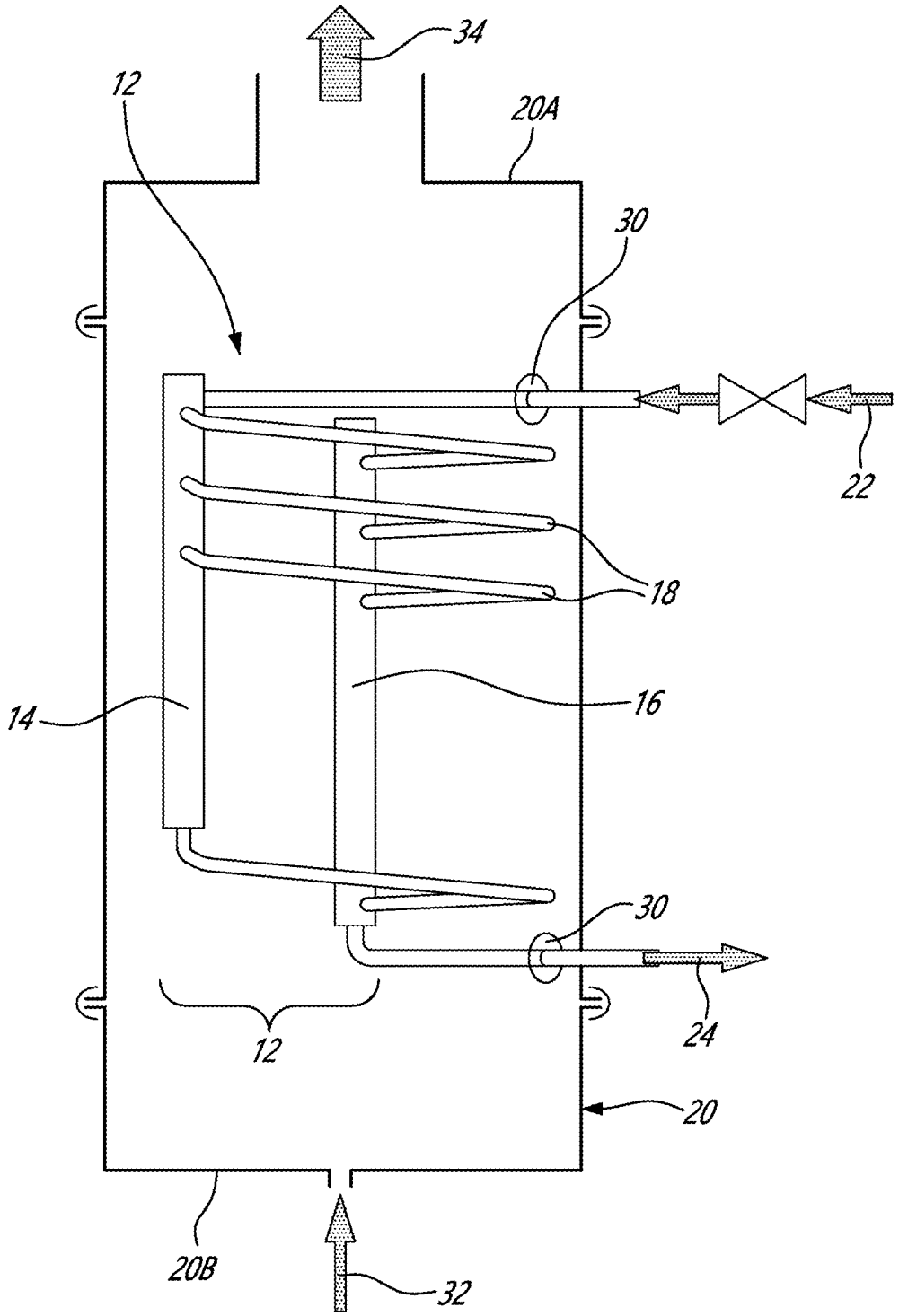
FIG. 5 is a schematic view of a humidifier according to an embodiment of an aspect of the present disclosure.

In FIGS. 3C, 4B and 5 for example, the tank 20 is shown as a cylinder having a top 20A and a base 20B, comprising a drain and fluid inlet port 32 for fluid in and out of the tank 20, and a steam outlet 34 (see FIG. 5), pressurized steam or a high temperature fluid such as hot water for example being passed through the heat exchanger boiling the fluid fed from the port 32 and contained in the tank to produce steam, which exits the tank through the steam outlet 34.

The heat exchanger 12 comprises a steam collector 14 and a condensate collector 16 connected together by a heat exchanger array 18 of tubes (see FIGS. 3A, 4A, 5) or coils (see FIGS. 6) 18 (see connectors 15 between collectors 16, 14 and tubes in FIG. 4A for example). The steam collector 14 is fed from a supply port 22 of pressurized steam or high temperature fluid such as hot water, and the condensate collector 16 leads to a condensate return port 24.

In an embodiment illustrated for example in FIGS. 3-5, the heat exchanger array 18 comprises a number of vertically-stacked C-shaped tubes. The tubes 18 may be cylindrical or square tubes, with W or S shape for example or other shapes (not shown), and formed or assembled from standard elbows and tubing for example. In an embodiment illustrated for example in FIGS. 6, the heat exchanger array 18 comprises a number of vertically-stacked coils. The collectors 14 and 16 are vertical tubular members, of a cylindrical or square or octagonal for example or other cross section.

Figure 7A:
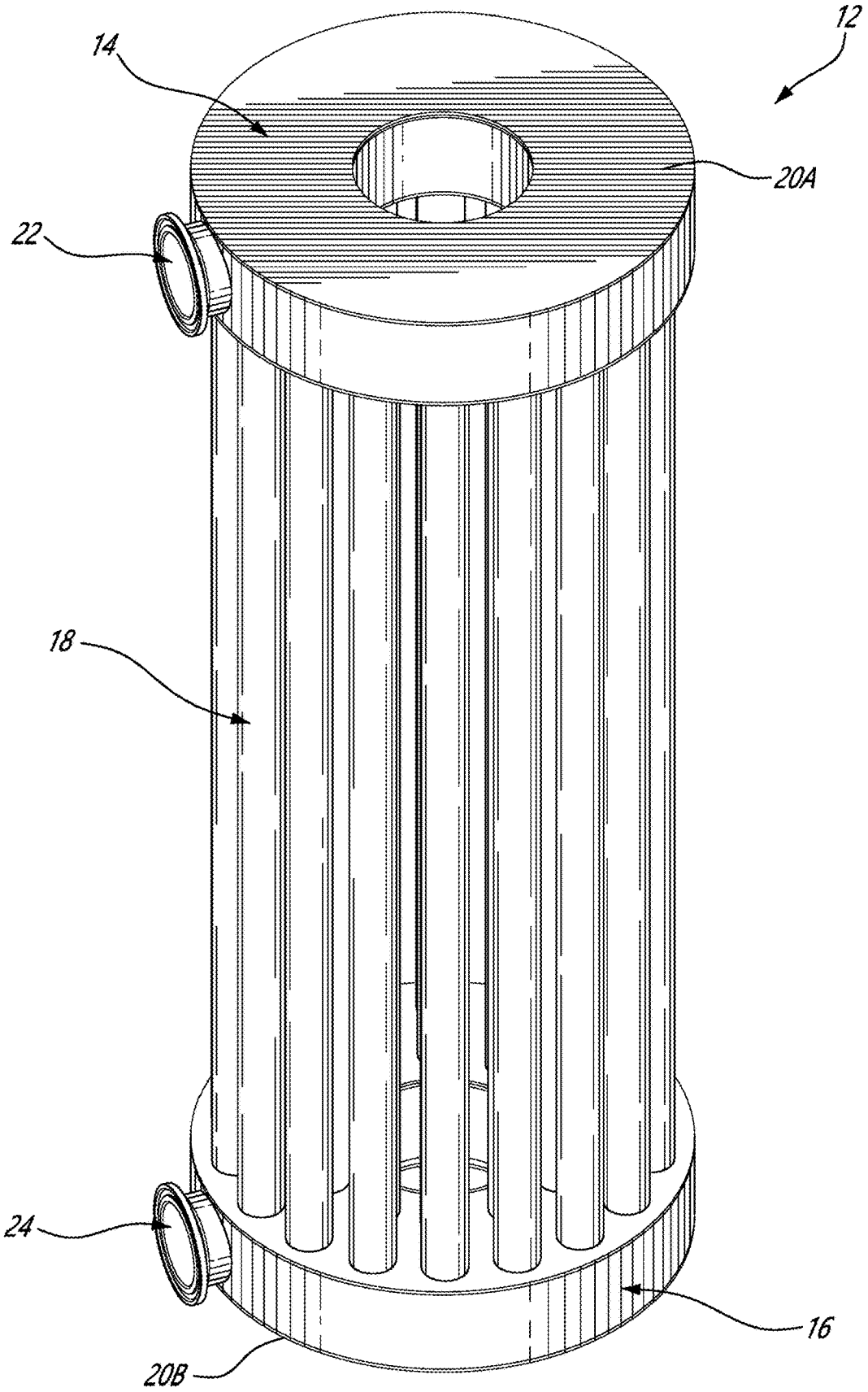
FIG. 7A shows a to perspective view of a heat exchanger according to an embodiment of an aspect of the present disclosure.
Figure 7B:
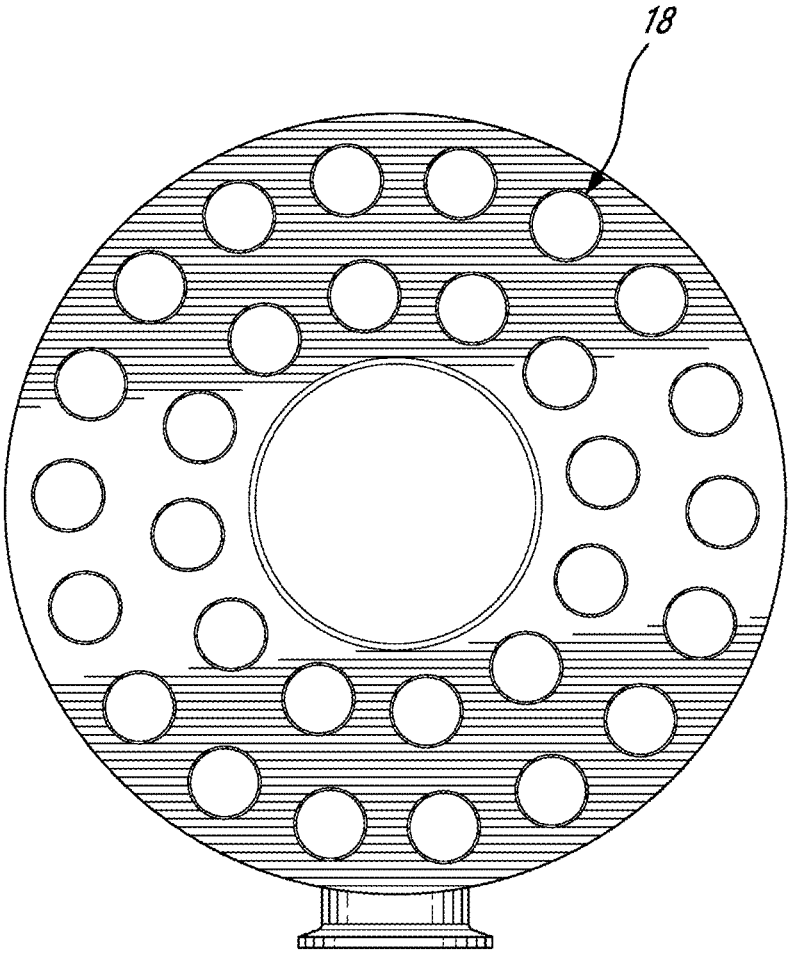
FIG. 7B shows a side view the heat exchanger of FIG. 7B.
Figure 7C:
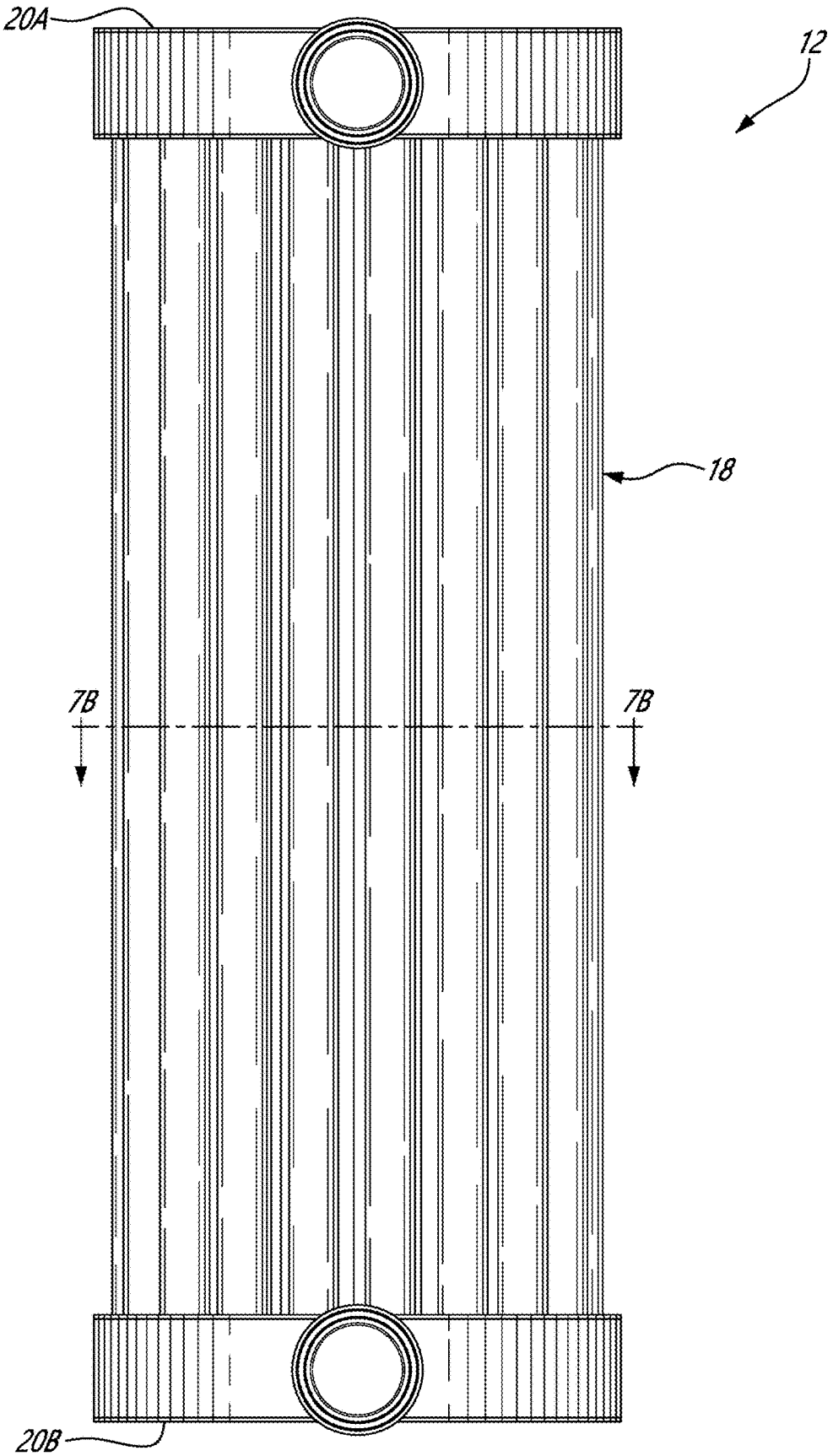
FIG. 7C shows a top view of the heat exchanger of FIG. 7A.

In an embodiment illustrated for example in FIGS. 7, the condensate collector 16 and the steam collector 14 are shown as a top and a bottom collecting boxes, and the heat exchanger array 18 comprises a number of vertical tubes extending from the condensate collector 16.

The diameter and the length, and, in the case of coils, the spiral radius curvature, and the number of the tubes or coils of the heat exchanger array 18 are selected according to the size and cross section of the tank, in such a way to maximize heat transfer from the steam or fluid inside the heat exchanger array 18 to the surrounding fluid within the tank, as well as evacuation of condensate from the tubes or coils.

The collectors 14, 16 and the tubes or coils of the heat exchanger array 18 may be made of stainless steel, copper or a combination of these materials, or of other materials selected in accordance with target coefficient of heat transfer, and also in view of descaling efficiency resulting from thermal expansion and contraction of the material associated with temperature variations in the surrounding environment, which is found to break accumulated scale and thus facilitate scale detachment from walls of the tubes or coils of the heat exchanger array 18 and thus prevent clogging by accumulated scale.

As best seen in FIG. 5, the slope of the tubes or coils, defined as the height difference between the steam inlet of a tube in the steam collector 14 fed from the steam or high temperature fluid supply port 22 and the condensate return port 24 of the tube into the condensate collector 16 leading to the condensate return port 24 (see FIG. 5 for example), is selected to optimize condensate evacuation from the tubes or coils and thereby prevent flooding of the heat exchanger, which may otherwise occur in case of poorflow of condensate resulting in decreased flow of steam inside of the tubes or coils and thus decrease in the heat transfer efficiency of the heat exchanger.

In an embodiment as illustrated in FIGS. 7, the heat exchanger comprises vertical tubes, which provides an optimized slope in terms of optimizing condensate evacuation; scale may accumulate at the basis of the heat exchanger may lead to clogging between the feet of the tubes. In an embodiment as illustrated in FIGS. 6, the heat exchanger comprising coils provides the same optimized slope in terms of optimizing condensate evacuation.

Figure 6A:
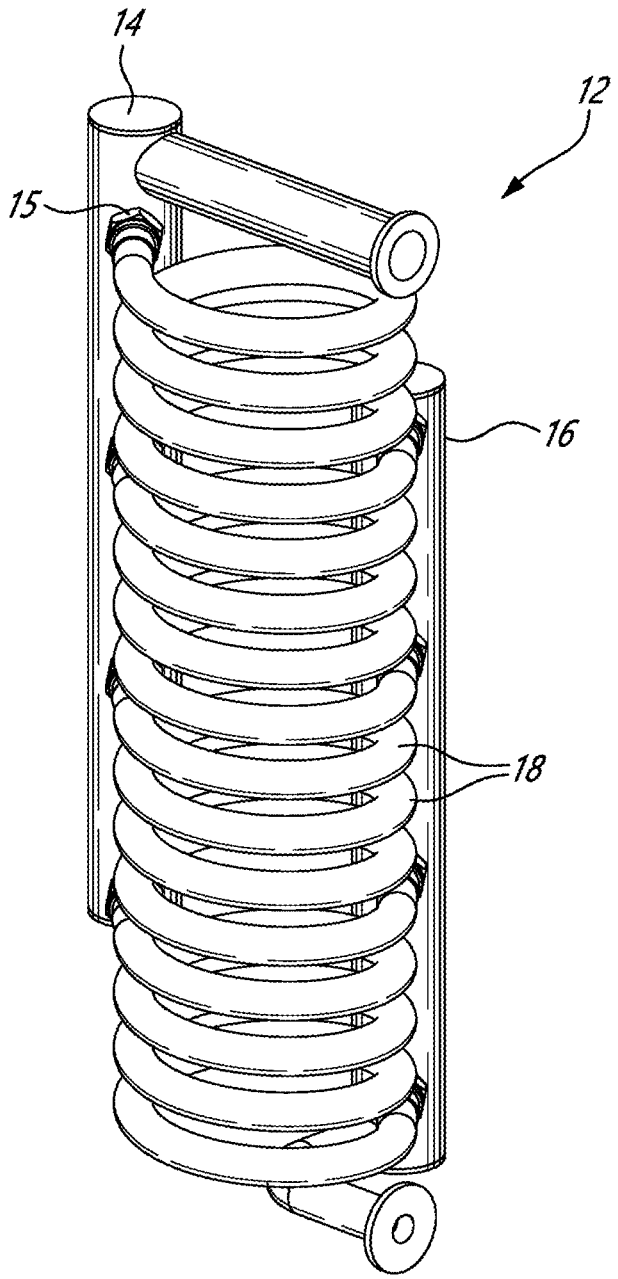
FIG. 6A shows an isometric view of a heat exchanger according to an embodiment of an aspect of the present disclosure.
Figure 6B:
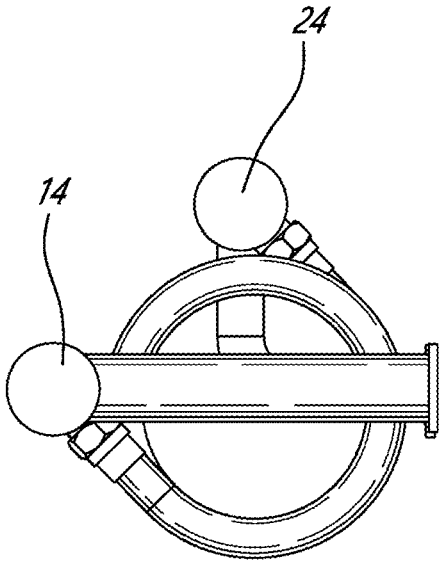
FIG. 6B shows a top view of the heat exchanger of FIG. 6A.
Figure 6C:
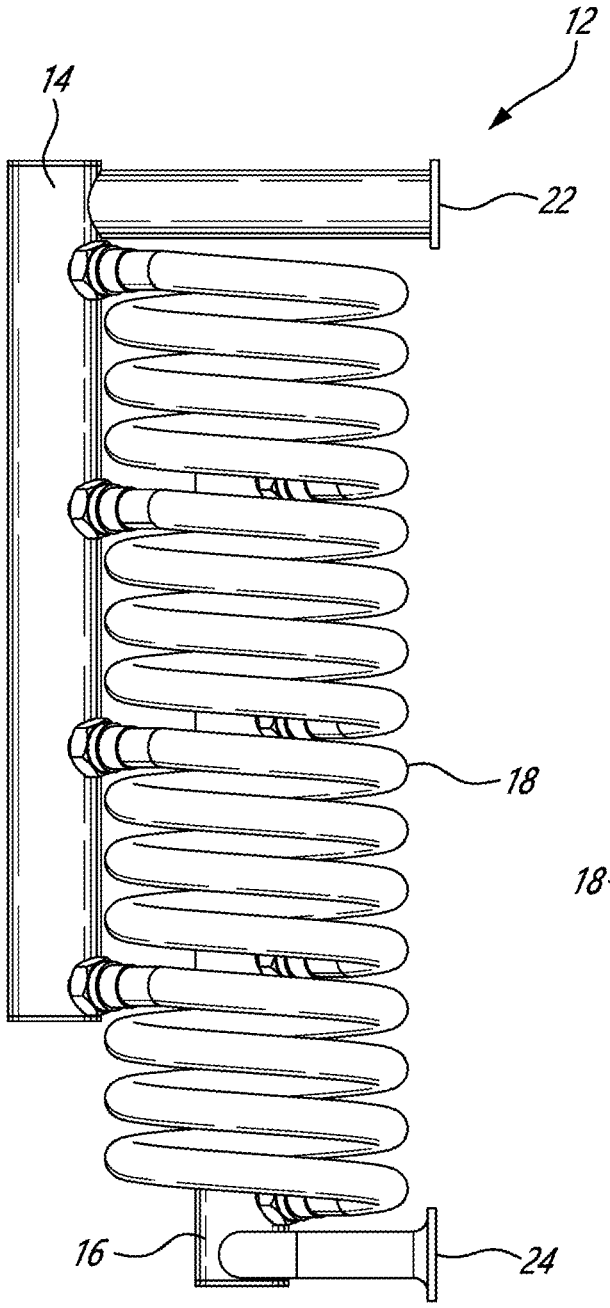
FIG. 6C shows a side view of the heat exchanger of FIG. 6A.
Figure 6D:
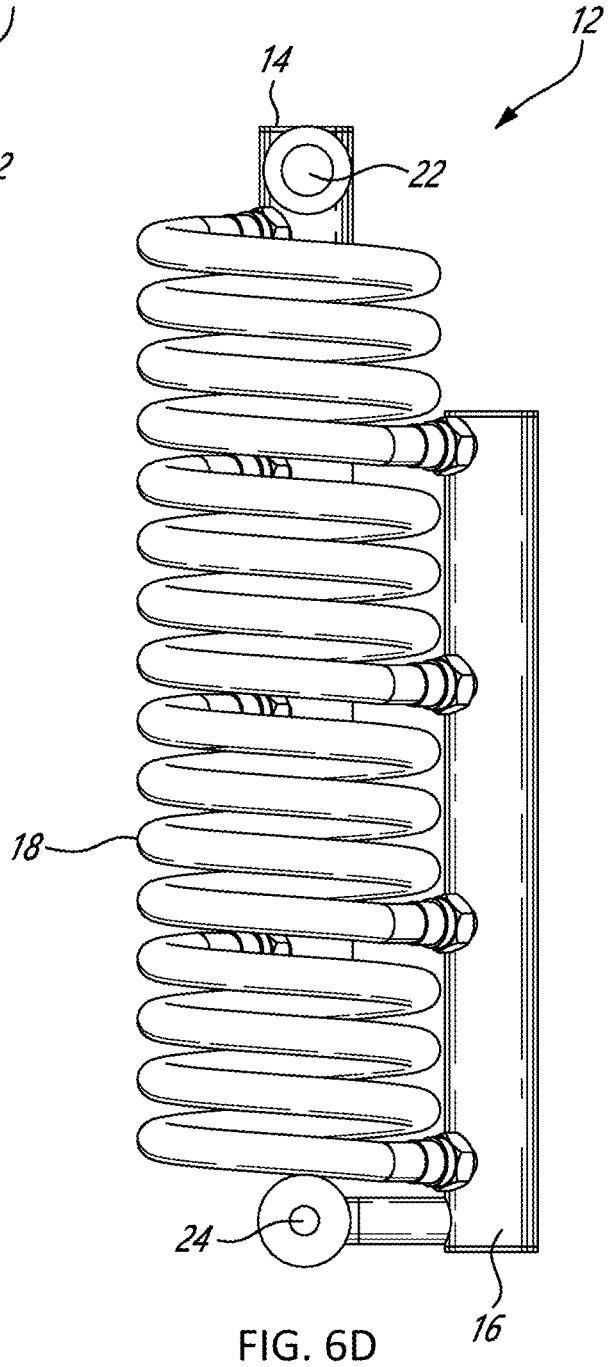
FIG. 6D shows a side view of the heat exchanger of FIG. 6A.

As shown in FIG. 6A in the case of 4 coils, each comprising 4 spires, the length of each coil being selected to optimize condensate evacuation in order to prevent obstruction, there are 4 connections between the coils 18 and the vertical collector 14 and 4 connections between the coils 18 and the vertical collector 16, which would correspond to a tube alternative of 16 C-shaped tubes and thus 32 connections (9 C-shaped tubes and 32 connections 15 are shown in FIG. 4A). The tubes may be selected with a diameter of ¾ inch or 1 inch for example, coils may be selected with a diameter of ¾ inch for example, depending of the size of the tank and heat exchanger combination.

The tank and heat exchanger combination as described in the present disclosure thus efficiently integrates the heat exchanger into a vertical tank.

The exchanger 12 may be secured inside the tank 20 using connectors 30 (see FIG. 5) selected to be readily removed for disassembly of the combination. The steam supply port 22 and the condensate return port 24 may be readily reconnected on either side of the heat exchanger array once the heat exchanger is positioned inside the tank (see FIG. 5).

As mentioned hereinabove, scale, which detaches from walls of the heat exchanger during operation, under dilatation and contraction of the material of the walls and tubes of the heat exchanger, falls down to the base 20A of the tank 20. The base 20 B of the tank 20 is removably connected to the body of the tank 20 by a O-ring for example, in such a way that the scale can be disposed of and the heat exchanger 12 can be readily removed from the body of the tank 20B for cleaning and descaling in case tap water is used for humidification for instance.

The present combination allows controlling the water level in such a way that operation is performed with a minimized volume of water to heat and boil compared with horizontal assemblies, and thus allows improved response time and accuracy of the humidifier, thus reducing the water consumption and increasing energy efficiency since less water and less energy is needed.

In more details, the steam exchange humidifier produces atmospheric steam for air humidification when the heat exchanger 12 is in contact with water available for boiling within the tank 20. In absence of water contact with the heat exchanger surface, the pressurized steam inside the heat exchanger 12 remains at a temperature below the maximum temperature of the material of the heat exchanger 12, and there is not steam production. Thus, the capacity of atmospheric steam for humidification is proportional to the surface of the heat exchanger 12 in contact with water, which is dependent on the water level within the tank 20. In the combination of the present disclosure, the water level in the tank 20, and thus the water level in contact with the surface of the heat exchanger 12, is controlled over the entire height of the heat exchanger 12, thus allowing correspondingly controlling the steam output. In contrast, in horizontal configurations, since even a small water level reduction exposes a large heat exchanger surface, resulting in a correspondingly large reduction of atmospheric steam production, target atmospheric steam production needs be controlled using an actuated control valve pressurized steam proportional opening. Moreover, control of the water level in the tank of the present combination allows operation with less volume of water to heat and boil compared with horizontal configurations, and improved response time and accuracy of the humidifier.

A vertical combination as described herein is found to reduce the floor space required for the humidifier, or to facilitate wall mounting without requiring additional specific mounting hardware since the combination is typically lighter since the volume of water used under operation is reduced, as described hereinabove. Thus, maintenance and cleaning may be achieved without tools or consumables as opposed to an horizontal assembly, which typically requires top and/or side access to the tank through bolted side access doors sealed with flat gaskets that need to be replaced or repaired as part as the regular disassembly for scheduled descaling and/or cleaning and service operation when tap water is used. In the combination of the present disclosure, the scale may be collected at the bottom of the tank over time and the bottom of the tank may readily removable for cleaning and descaling.

The scope of the claims should not be limited by the embodiments set forth in the examples, but should be given the broadest interpretation consistent with the description as a whole.

The invention claimed is:

1. A steam exchange humidifier, comprising a heat exchanger inside a tank, the tank-comprising a drain and a fluid inlet port for fluid in and out of the tank and a steam outlet; the heat exchanger comprising a heat exchanger array, a steam collector connected to a steam supply port, a condensate collector connected to a condensate return port; the steam collector and the condensate collector being connected by the heat exchanger array;

wherein the heat exchanger array comprises vertically stacked tubes having slope and each tube being connected between the steam collector and the condensate collector, the slope is defined by a height difference between the steam collector and the condensate collector, and wherein the tank is a generally vertical body and the base of the tank is removably connected to the body of the tank by a O-ring.

2. The steam exchange humidifier of claim 1, wherein the tank is a vertical cylinder.

3. The steam exchange humidifier of claim 1, wherein the condensate collector and the steam collector are vertical tubular members.

4. The steam exchange humidifier of claim 1, the condensate collector and the steam collector are vertical tubular members of one of: a cylindrical cross section, a square cross section and an octagonal cross section.

5. The steam exchange humidifier of claim 1, wherein the heat exchanger array comprises vertically stacked tubes, each tube being connected between the steam collector and the condensate collector, wherein a diameter, a length, and a number of the tubes are selected according to a size and a cross section of the tank.

6. The steam exchange humidifier of claim 1, wherein the heat exchanger array comprises vertically stacked coils, each coil being connected between the steam collector and the condensate collector.

7. The steam exchange humidifier of claim 1, wherein the heat exchanger array comprises vertically stacked coils, each coil being connected between the steam collector and the condensate collector, wherein a diameter, a length, a spiral radius curvature and a number of the coils are selected according to a size and a cross section of the tank.

8. The steam exchange humidifier of claim 1, wherein the heat exchanger array comprises a number of vertical tubes extending from the condensate collector to the steam collector, the steam collector being a top collecting box and the condensate collector being a bottom collecting box.

9. The steam exchange humidifier of claim 1, wherein the heat exchanger array, the condensate collector and the steam collector are made of one of: stainless steel, copper, and a combination thereof.

10. The steam exchange humidifier of claim 1, wherein the heat exchanger array, the condensate collector and the steam collector are made in materials selected in accordance with a target coefficient of heat transfer.

11. The steam exchange humidifier of claim 1, wherein the heat exchanger array, the condensate collector and the steam collector are made in materials selected in view of descaling efficiency resulting from thermal expansion and contraction of the materials.

12. The steam exchange humidifier of claim 1, wherein the heat exchanger array comprises ones of: i) vertically stacked coils and ii) vertically stacked tubes, a slope of the tubes or coils being selected to optimize condensate evacuation from inside of the tubes or coils.

13. The steam exchange humidifier of claim 1, wherein the heat exchanger array comprises vertically stacked coils, the coils having a diameter of ¾ inch.

14. The steam exchange humidifier of claim 1, wherein the heat exchanger array comprises vertically stacked tubes, the tubes having one of: i) a diameter of ¾ inch and ii) a diameter of 1 inch, selected according to a size of the tank.

15. The steam exchange humidifier of claim 1, wherein the heat exchanger is secured inside the tank using connectors selected to be readily removed, in such a way that the heat exchanger is readily removable from the tank.

16. The steam exchange humidifier of claim 1, wherein a base of the tank is removable from a body of the tank.

17. The steam exchange humidifier of claim 1, wherein the steam supply port and the condensate return port are connected on either side of the heat exchanger array once the heat exchanger is positioned inside the tank.

18. The steam exchange humidifier of claim 1, wherein fluid level in the tank is controlled over an entire height of the heat exchanger array.

19. The steam exchange humidifier of claim 1, using pressurized steam or a high temperature fluid.

* * * * *